US008427073B2

(12) United States Patent
Kung et al.

(10) Patent No.: US 8,427,073 B2
(45) Date of Patent: Apr. 23, 2013

(54) LED DRIVING CIRCUIT AND BACKLIGHT MODULE

(75) Inventors: Wei Liang Kung, Taipei (TW); Chen-Hsung Wang, Taipei County (TW); Shian-Sung Shiu, Taipei County (TW)

(73) Assignees: Green Solution Technology Co., Ltd., New Taipei (TW); Niko Semiconductor Co., Ltd., New Taipei (TW)

( * ) Notice: Subject to any disclaimer, the term of this patent is extended or adjusted under 35 U.S.C. 154(b) by 339 days.

(21) Appl. No.: 12/786,823

(22) Filed: May 25, 2010

(65) Prior Publication Data

US 2010/0301762 A1 Dec. 2, 2010

(30) Foreign Application Priority Data

May 27, 2009 (CN) ..... 2009 1 0145226

(51) Int. Cl.
*H05B 37/02* (2006.01)

(52) U.S. Cl.
USPC ..... 315/297; 315/193; 315/312

(58) Field of Classification Search ..... 315/185 R, 315/193, 291, 294, 297, 307, 312
See application file for complete search history.

(56) References Cited

U.S. PATENT DOCUMENTS

| | | | | |
|---|---|---|---|---|
| 7,906,913 | B2 * | 3/2011 | Bouchard | 315/82 |
| 7,919,925 | B2 * | 4/2011 | Ito et al. | 315/82 |
| 2009/0189539 | A1 * | 7/2009 | Deng et al. | 315/294 |
| 2009/0302776 | A1 * | 12/2009 | Szczeszynski | 315/246 |
| 2010/0164403 | A1 * | 7/2010 | Liu | 315/297 |

* cited by examiner

*Primary Examiner* — Tung X Le
(74) *Attorney, Agent, or Firm* — Rosenberg, Klein & Lee

(57) ABSTRACT

A LED driving circuit and a backlight module using the same are disclosed. The LED driving circuit comprises a LED module and a current controlling unit. The LED module has a plurality of the LED strings, each having a driving terminal. The current controlling unit has a plurality of current balancing terminal coupled to the driving terminal, for balancing the currents flowing through the LED strings. The current controlling unit receives a mode switch signal, controls the amount of the currents of the LED strings about a first current value when the mode switch signal represent a first mode, and controls the amount of the currents of the LED strings about a second current value when the mode switch signal represent a second mode.

14 Claims, 2 Drawing Sheets

LED DRIVING CIRCUIT AND BACKLIGHT MODULE

BACKGROUND OF THE INVENTION (1) Field of the Invention

The present invention relates to a LED driving circuit and a backlight module. More particularly, the invention relates to a LED driving circuit and a backlight module which perform mode switching according to a dimension switching signal of a LCD panel.

(2) Description of the Prior Art

Compared with a conventional light source, the light emitting diode (LED), having many advantages, including low working voltage, high efficiency, long lifespan, colorful light, directionally lighting, and mercury-less, etc, is capable of supplying white light and colorful light with wider color gamu without infrared and ultraviolet spectrum. The shortcomings of the LED as light source, i.e., high-cost, heat, has been got over, and so it becomes a trend for the LED instead of the traditional illumination source. Therefore, in large screen LCD, the penetration of the LED backlight is increased unceasingly and so it promotes the growth of LED industry substantially.

The current trend for the LCD is 3D display. Especially adding fuel to the flames of 3D movie in recent years, the 3D LCD has been accepted by the user gradually. However, since most of display applications have majority in displaying 2D image content, the LCD must be capable of displaying 2D and 3D images by switching. The LCD must provide different brightness corresponding to 2D and 3D mode, but the LED driving controller, mainly having dimming function, can not satisfy the request. Namely, LED driving controller must provide the dimming function as well as brightness adjusting when switching between 2D and 3D modes.

SUMMARY OF THE INVENTION

In the foregoing related art, the LED driver cannot provide the different brightness according to the dimension displaying mode of the LCD monitor. Accordingly, the exemplary embodiment of the invention uses the LED driving circuit to provide the current balancing function of the LED module and to provide the different current flowing through the LED module according to a dimension mode switch signal, so as to provide the different brightness for the LED module corresponding to the different displaying mode. Furthermore, the invention also achieves the dimming control by a controller according to a dimming signal.

An exemplary embodiment of the invention provides a LED driving circuit, comprising a LED module and a current controlling element. The LED module comprises a plurality of the LED strings and each LED string has a driving terminal. The current controlling element has a plurality of current balancing terminal respectively coupled to the plurality of driving terminal for balancing an amount of current flowing through each of the plurality of the LED strings. Wherein, the current controlling element receives a mode switch signal, and accordingly controls the amount of the currents of the LED strings at a first current value when the mode switch signal represent a first mode, and controls the amount of the currents of the LED strings at a second current value when the mode switch signal represent a second mode.

Another exemplary embodiment of the invention provides a backlight module, comprising a LED module, a converting circuit, a current controlling element, and a controller. The converting circuit coupled with an input power source for converting an electrical power of the input power source into an output voltage according to a control signal to drive the LED module. The current controlling element coupled with the LED module for balancing currents flowing LEDs of the LED module. The controller receives a voltage feedback signal indicative of the output voltage to stable the output voltage and receives a dimming signal to adjust brightness of the LED module. Wherein, the current controlling element receives a mode switch signal, and accordingly controls the amount of the currents of the LED strings at a first current value when the mode switch signal represent a first mode, and controls the amount of the currents of the LED strings at a second current value when the mode switch signal represent a second mode.

It is to be understood that both the foregoing general description and the following detailed description are exemplary, and are intended to provide further explanation of the invention as claimed. In order to make the features and the advantages of the invention comprehensible, exemplary embodiments accompanied with figures are described in detail below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

Figure 1:
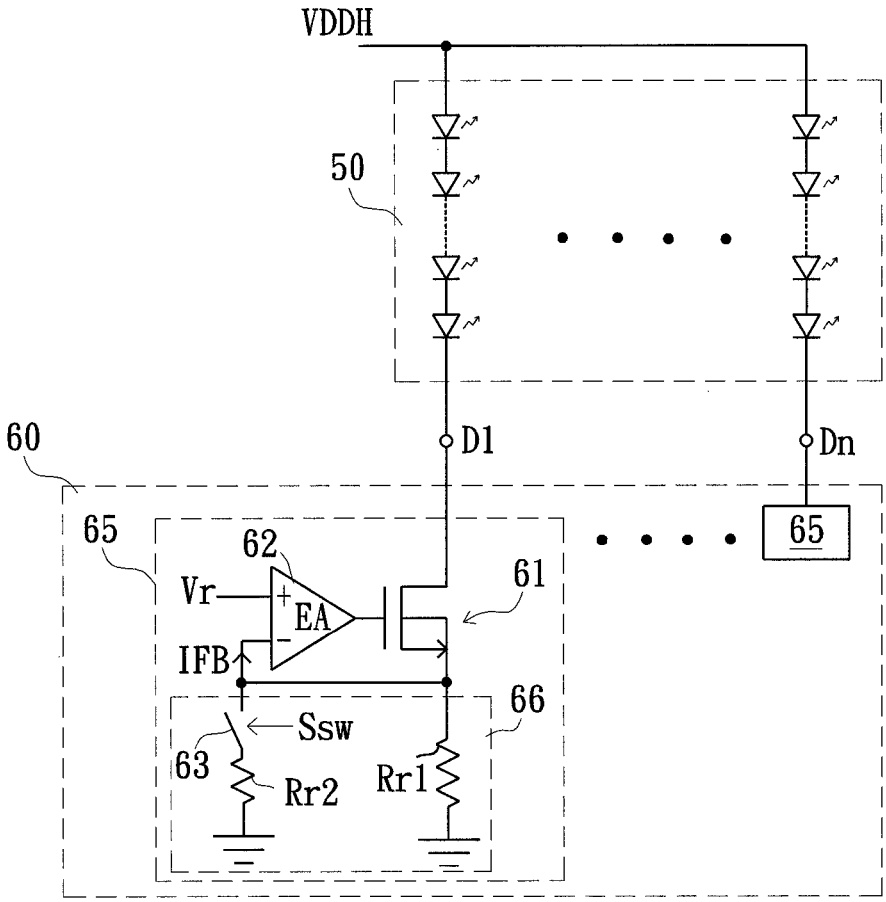
FIG. 1 is a schematic view of a LED driving circuit according to the invention.

FIG. 1 is a schematic view of a LED driving circuit according to the invention. Referring to FIG. 1, the LED driving circuit includes a LED module 50 and a current controlling element 60. The LED module 50 comprises a plurality of the LED strings. A terminal of each of the LED strings is coupled with each other and coupled to a driving voltage VDDH to receive an electric power and each of the LED string has a driving terminal. The current controlling element 60 has a plurality of current controlling units 65. The plurality of current controlling units 65 has current balancing terminals D1~Dn respectively coupled to the plurality of driving terminals of the plurality of the LED strings in the LED module 50 for balancing driving currents of the plurality of the LED strings. In the present embodiment, each of the plurality of current controlling units 65 comprises a first transistor switch 61, an error amplifier 62 and a resistance adjusting unit 66, wherein the resistance adjusting unit 66 includes a second transistor switch 63, a first detecting unit Rr1 and a second detecting unit Rr2. A first terminal of the first transistor switch 61 is one of the current balance terminals D1~Dn, and second terminal thereof is coupled to the ground via the first detecting unit Rr1 and generated a current detecting signal IFB. Wherein the level of the current detecting signal IFB is indicative of an amount of current flowing through a corresponding current balancing terminal, i.e., the current flowing through the corresponding LED string. A first terminal of the second transistor switch 63 is coupled to the second terminal of the first transistor switch 61 and a second terminal thereof is coupled to the ground via the second detecting unit Rr2.

The error amplifier 62 has a non-inverting terminal of the error amplifier 62 receiving a reference voltage signal Vr, an inverting terminal receiving the current detecting signal IFB and an output terminal coupled to a controlling terminal of the first transistor switch 61 and accordingly performs a feedback compensation to control the first transistor switch 61 to have the levels of the reference voltage signal Vr and the current detecting signal IFB being equal. Therefore, the amount of current of the corresponding LED string is stabled at a current value. The second transistor switch 63 is controlled by a mode switch signal Ssw and so the first detecting unit Rr1 is coupled/uncoupled to the second detecting unit Rr2 by the switching of the second transistor switch 63. The mode switch signal Ssw may be a dimension switch signal for switching a displaying mode of LCD monitor in 2D mode and 3D mode. When the mode switch signal Ssw represents a first mode, e.g. high level, the second transistor switch 63 is turned on. The second detecting unit Rr2 and the first detecting unit Rr1 are connected in parallel and so the resistance adjusting unit 66 has a lower equivalent resistance. At this time, the first transistor switch 61 is flowed through by a larger current to keep the levels of the current detecting signal IFB and the reference voltage signal Vr equal. When the mode switch signal Ssw represents a second mode, e.g. low level, the second transistor switch 63 is turned off. The detecting current is generated by only the first detecting unit Rr1, and so the resistance adjusting unit 66 has a higher equivalent resistance. At this time, the first transistor switch 61 is flowed through by a smaller current to still keep the levels of the current detecting signal IFB and the reference voltage signal Vr equal. In the present embodiment, all the plurality of the current controlling units 65 receive the same reference voltage signal Vr to controls an amount of current flowing through corresponding the plurality of the LED strings. As described above, the equivalent resistance of the resistance adjusting unit 66 is adjusted according to the mode switch signal Ssw presently and thereby the amount of currents of the current balancing terminals is adjusted with respect to the mode of the switch signal Ssw.

Figure 2:
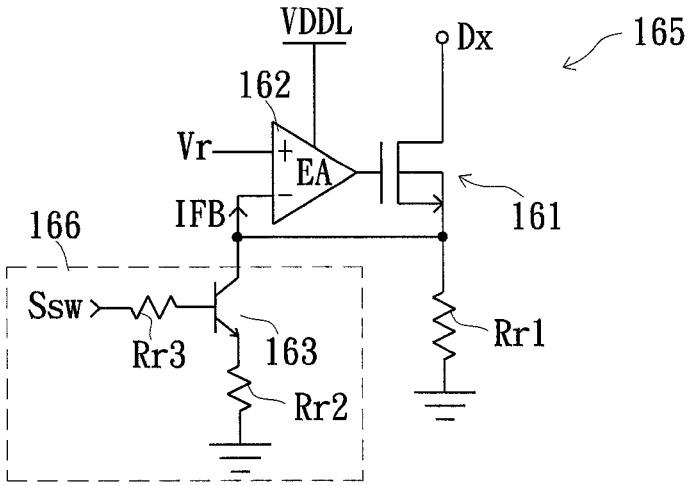
FIG. 2 is a schematic view of a current controlling unit according to the invention.

FIG. 2 is a schematic view of a current controlling element according to the invention. Referring to FIG. 2, the current controlling unit 165 includes a first transistor switch 161, a first detecting unit Rr1, an error amplifier 162 and a current adjusting unit 166. A terminal of the first transistor switch 161 is one current balancing terminal Dx among the current balance terminals D1~Dn, coupled to a driving terminal of the corresponding LED string. The error amplifier 162 receives a supply voltage VDDL that provides the electric power to error amplifier 162 for operating. It should be mentioned that the driving voltage of the supply voltage VDDL can different from that for the current controlling element, and preferably the voltage level of the supply voltage VDDL is higher than that of the driving voltage of the current controlling element. Therefore, the error amplifier 162 can provide a signal with higher level to control the gate of the first transistor switch 161, so as to achieve the advantage for reducing the turn-on resistance of the first transistor switch 161. The error amplifier 162 has a non-inverting terminal receiving a reference voltage signal Vr, an inverting terminal receiving a current detecting signal IFB by the first detecting unit Rr1 and accordingly performs a feedback compensation to control the first transistor switch 161. The current adjusting unit 166 includes a second transistor switch 163, a second detecting unit Rr2 and a resistance unit Rr3. A first terminal of the second transistor switch 163 is coupled to the connecting point of the first transistor switch 161 and the first detecting unit Rr1 and a second terminal thereof is coupled to the ground via the second detecting unit Rr2. A controlling terminal of the second transistor switch 163 receives the mode switch signal Ssw via resistance unit Rr3. In this present embodiment, the second transistor switch is a bipolar junction transistor (BJT) and according to a mode switch signal Ssw controls an amount of the current flowing through the current balancing terminal Dx. When the mode switch signal Ssw is at a low level, the second transistor switch 163 is turned off. The current flowing through the current balancing terminal Dx flows through a first detecting unit Rr1 to generate the current detecting signal IFB having a level as same as that of the reference voltage signal Vr. At this time, the amount of the current flowing through the current balancing terminal Dx is a first current value. When the mode switch signal Ssw is at a high level, the second transistor switch 163 is turned on to be flowed through by a stable current. At this time, the amount of the current of the current balancing terminal Dx is a second current value, wherein a portion of the current flowing through the current balancing terminal Dx flows through the first detecting unit Rr1 and the other portion thereof flows through the current adjusting unit 166. Even the current be shunted by the first detecting unit Rr1 and the current adjusting unit 166, the level of the current detecting signal IFB is still kept to be equal to that of the reference voltage signal Vr, i.e. the second current value is larger than the first current value by the amount of the current flowing through the current adjusting unit 166. Therefore, by the current shunt of the current adjusting unit 166, the amount of the current of the current balancing terminal could be adjusted according to the mode switch signal Ssw.

Beside the circuit architecture of the current controlling element in the above-mentioned embodiments, a circuit capable of current balancing, such as current mirror, may be used in the present invention to have balancing the currents of the plurality of the LED strings.

Figure 3:
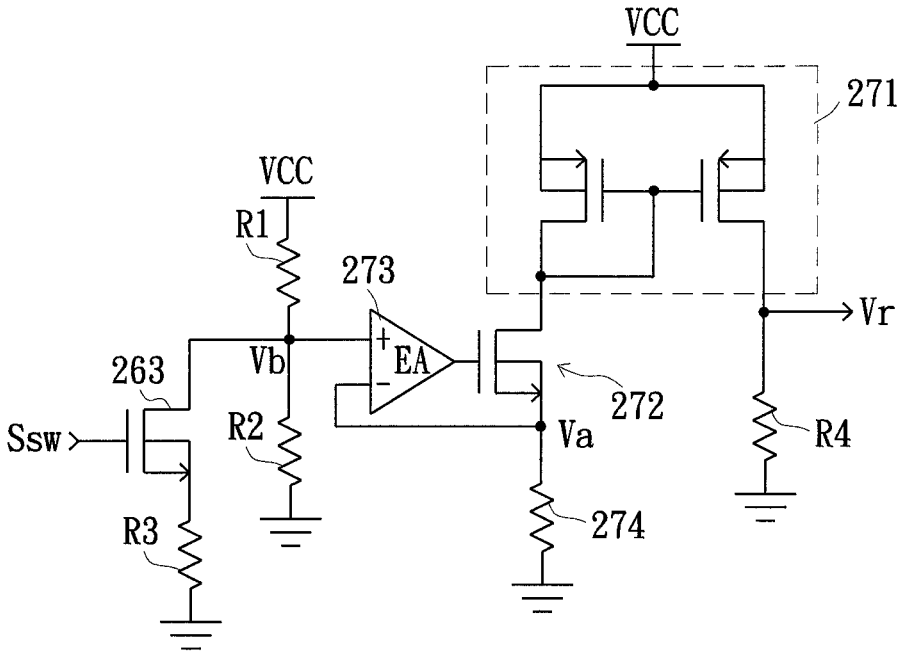
FIG. 3 is a schematic view of a reference voltage generator according to the invention.

The present invention may adjust the current flowing through the current balancing terminal by adjusting the reference voltage signal Vr to switch mode, other than adjusting the current detecting signal IFB depicted in the embodiments mentioned above. That is, the resistance adjusting unit 66 as shown in FIG. 1 may be replaced with a circuit as shown in FIG. 3 and the current adjusting unit 166 as shown in FIG. 2 may be replaced with the same. FIG. 3 is a schematic view of a reference voltage generator according to the invention. Referring to FIG. 3, the reference voltage generator includes a current mirror 271, a first transistor switch 272, a second transistor switch 263, an error amplifier 273, a first detecting unit 274 and reference resistances R1, R2, R3 and R4. The reference resistances R1 and R2 are connected in series between the supply voltage VCC and the ground. The reference resistance R3 is coupled to the connecting point of the reference resistances R1 and R2 via the second transistor switch 263, so as to generate a voltage division signal Vb to a non-inverting terminal of the error amplifier 273. The first transistor switch 272 and the first detecting unit 274 are connected in series between the current mirror 271 and the ground, and the connecting point of the first transistor switch 272 and the first detecting unit 274 generates a current detecting signal Va to an inverting terminal of the error amplifier 273. Accordingly, the output terminal of the error amplifier 273 outputs a signal to control the equivalent resistance of the first transistor switch 272, such that the level of the current detecting signal Va and of the voltage division Vb are equal to make the current flowing through the first detecting unit 274 stable. The current mirror 271 is coupled to the supply voltage Vcc. A terminal of the current mirror 271 is coupled to the first detecting unit 274 via the first transistor switch 272. Another terminal of the current mirror 271 generates a mirrored current flowing through the reference resistance R4 to generate a reference voltage signal. The second transistor switch 263 is switched according to the mode switch signal Ssw to have the current detecting signal Vb with different levels. When the mode switch signal Ssw is at a high level, the second transistor switch 263 is turned on. At this time, the current detecting signal Vb has a lower level. When the mode switch signal Ssw is at a low level, the second transistor switch 263 is turned off. At this time, the current detecting signal Vb has a higher level. Therefore, by adjusting the level of the current detecting signal Vb, the current flowing through the reference resistance R4 can be adjusted and further generates the reference voltage signal Vr having the different level. In the embodiment, the reference voltage signal Vr generated by the reference voltage generator can be provided to the non-inverting terminal of the error amplifier as shown in FIG. 1 and FIG. 2.

Figure 4:
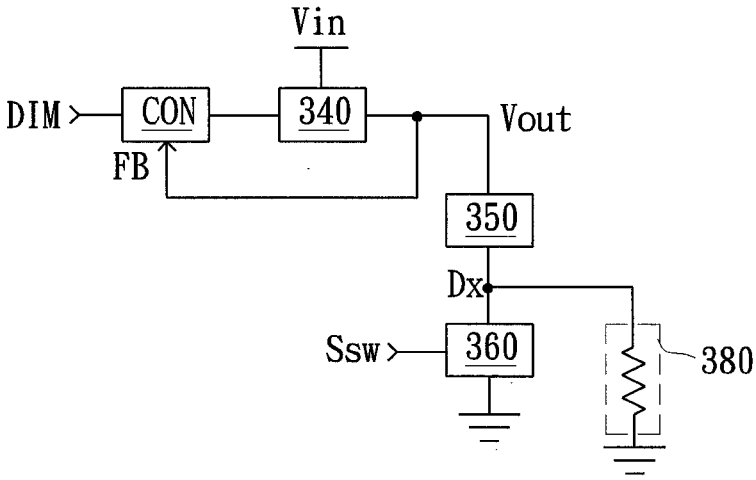
FIG. 4 is a schematic view of a backlight module according to the invention.

FIG. 4 is a schematic view of a backlight module according to the invention. Referring to FIG. 4, the backlight module includes a converting circuit 340, a LED module 350, a current controlling element 360, a controller CON and a voltage clamping unit 380. The converting circuit 340 is coupled to an input power source Vin for converting an electrical power from the input power source Vin into an output voltage Vout according to a control signal, for driving the LED module 350. The controller CON receives a voltage feedback signal FB indicative of the output voltage Vout to stable the output voltage Vout. The controller CON receives a dimming signal DIM to adjust brightness of the LED module 350. The current controlling element 360 has at least one of the current balancing terminal Dx, respectively coupled to the LED strings of the LED module 350, for stabling current(s) flowing through LEDs of the LED module. In addition, the current controlling element 360 receives a mode switch signal Ssw, and accordingly controls the currents of the LED strings at a first current value when the mode switch signal Ssw represents a first mode, and controls the currents of the LED strings at a second current value when the mode switch signal Ssw represents a second mode. The voltage clamping unit 380 is coupled to the current balancing terminal Dx of the LED module 350 for limiting a cross voltage of the current controlling element 360. In the present embodiment, the voltage clamping unit 380 comprises at least one resistor, correspondingly coupled to at least one of the current balancing terminal Dx. When the dimming signal DIM represents "OFF", the current of the LED module 350 is zero and so the cross voltages of the LED strings in the LED module 350 is close to the threshold voltage thereof due to the voltage clamping unit 380 to avoid the voltage applied on the current controlling element 360 over the withstand voltage thereof.

As described above, the present invention completely fulfills the three requirements on patent application: innovation, advancement and industrial usability. In the aforementioned texts the present invention has been disclosed by means of preferred embodiments thereof; however, those skilled in the art can appreciate that these embodiments are simply for the illustration of the present invention, but not to be interpreted as for limiting the scope of the present invention. It is noted that all effectively equivalent changes or modifications on these embodiments should be deemed as encompassed by the scope of the present invention. Therefore, the scope of the present invention to be legally protected should be delineated by the subsequent claims.

What is claimed is:

1. A LED driving circuit, comprising:

a LED module, comprising a plurality of LED strings, each LED string having a driving terminal; and a current controlling element, having a plurality of current balancing terminal respectively coupled to the plurality of driving terminal for balancing an amount of current flowing through each of the plurality of the LED strings;

wherein, the current controlling element receives a mode switch signal, and accordingly controls the amount of the currents of the LED strings at a first current value when the mode switch signal represent a first mode, and controls the amount of the currents of the LED strings at a second current value when the mode switch signal represent a second mode, wherein, the first current value and the second current value are larger than zero.

2. The LED driving circuit according to claim 1, wherein the current control element comprises a plurality of current control units for providing the plurality of the current balancing terminals, each of the current balancing terminals receiving a reference voltage signal and a current detecting signal indicative of an amount of current flowing through a corresponding current balancing terminal so as to stable the current flowing through the corresponding current balancing terminal.

3. The LED driving circuit according to claim 2, wherein each of the current control unit has a resistance adjusting unit that generates the current detecting signal according to an equivalent resistance of the resistance adjusting unit and the current flowing through the corresponding current balancing terminal, and an equivalent resistance of the resistance adjusting unit is adjusted according to the mode switch signal.

4. The LED driving circuit according to claim 2, wherein each of the current control unit has a current adjusting unit coupled to the corresponding current balancing terminal, and shunting the current flowing from the corresponding current balancing terminal according to the mode switch signal.

5. The LED driving circuit according to claim 2, wherein the current controlling element further comprises a reference voltage generator generating the reference voltage signal, a level of that being adjusted according to the mode switch signal.

6. The LED driving circuit according to claim 1, wherein the mode switch signal is a dimension switch signal.

7. The LED driving circuit according to claim 6, wherein the current control element comprises a plurality of current control units for providing the plurality of the current balancing terminals, each of the current balancing terminals receiving a reference voltage signal and a current detecting signal indicative of an amount of current flowing through a corresponding current balancing terminal so as to stable the current flowing through the corresponding current balancing terminal.

8. The LED driving circuit according to claim 7, wherein each of the current control unit has a resistance adjusting unit that generates the current detecting signal according to an equivalent resistance of the resistance adjusting unit and the current flowing through the corresponding current balancing terminal, and an equivalent resistance of the resistance adjusting unit is adjusted according to the mode switch signal.

9. The LED driving circuit according to claim 7, wherein each of the current control unit has a current adjusting unit coupled to the corresponding current balancing terminal, and shunting the current flowing from the corresponding current balancing terminal according to the mode switch signal.

10. The LED driving circuit according to claim 7, wherein the current controlling element further comprises a reference voltage generator generating the reference voltage signal, a level of that being adjusted according to the mode switch signal.

11. A backlight module, comprising:

a LED module;

a converting circuit, coupled to an input power source for converting an electrical power of the input power source into an output voltage according to a control signal to drive the LED module;

a current controlling element, coupled to the LED module for balancing currents flowing LEDs of the LED module; and a controller, receiving a voltage feedback signal indicative of the output voltage to stable the output voltage and receiving a dimming signal to adjust brightness of the LED module;

wherein, the current controlling element receives a mode switch signal, and accordingly controls the amount of the currents of the LED strings at a first current value when the mode switch signal represent a first mode, and controls the amount of the currents of the LED strings at a second current value when the mode switch signal represent a second mode, wherein, the first current value and the second current value are larger than zero.

12. The backlight module according to claim 11, further comprising a voltage clamping unit coupled to the current controlling element for limiting a cross voltage of the current controlling element, wherein the voltage clamping unit comprises at least resistor.

13. The backlight module according to claim 11, wherein the mode switch signal is a dimension switch signal.

14. The backlight module according to claim 13, further comprising a voltage clamping unit coupled to the current controlling element for limiting a cross voltage of the current controlling element, wherein the voltage clamping unit comprises at least resistor.

* * * * *